US011065177B2

(12) United States Patent
Miner

(10) Patent No.: US 11,065,177 B2
(45) Date of Patent: Jul. 20, 2021

(54) SEXUAL AID APPARATUS WITH SAFETY DEVICE

(71) Applicant: Brendan Miner, St. Agustine, FL (US)

(72) Inventor: Brendan Miner, St. Agustine, FL (US)

( * ) Notice: Subject to any disclaimer, the term of this patent is extended or adjusted under 35 U.S.C. 154(b) by 680 days.

(21) Appl. No.: 15/982,650

(22) Filed: May 17, 2018

(65) Prior Publication Data

US 2019/0350801 A1 Nov. 21, 2019

(51) Int. Cl.

| | |
|---|---|
| ***A61H 19/00*** | (2006.01) |
| ***A61H 15/00*** | (2006.01) |
| ***A61H 23/02*** | (2006.01) |
| ***A61H 21/00*** | (2006.01) |

(52) U.S. Cl.

CPC ..... *A61H 19/44* (2013.01); *A61H 15/0085* (2013.01); *A61H 21/00* (2013.01); *A61H 23/02* (2013.01); *A61H 2201/0173* (2013.01)

(58) Field of Classification Search

CPC ..... A61H 19/00; A61H 19/30; A61H 19/32; A61H 19/34; A61H 19/40; A61H 19/44; A61H 19/50; A61H 21/00

See application file for complete search history.

(56) References Cited

U.S. PATENT DOCUMENTS 5,993,377 A * 11/1999 Hartwig ..... A61F 7/12 600/38
6,723,031 B1 * 4/2004 Wild ..... A63B 23/20 128/842
2003/0187323 A1 * 10/2003 Goodman ..... A42B 7/00 600/38
2007/0106109 A1 * 5/2007 Ly ..... A61H 19/44 600/38
2011/0190574 A1 * 8/2011 Maurette ..... A61F 5/41 600/38
2014/0309565 A1 * 10/2014 Allen ..... A61H 23/04 601/46

FOREIGN PATENT DOCUMENTS

KR 2006/084196 * 7/2006 ..... A61H 21/00

* cited by examiner

*Primary Examiner* — Carrie R Dorna
(74) *Attorney, Agent, or Firm* — Mark Terry

(57) ABSTRACT

A sexual aid apparatus with a safety feature includes (a) a shaft element configured to emulate a human penis and to be placed against genitals or inside a human orifice, (b) an electric vibrating motor located within the shaft element, the electric vibrating motor configured for vibrating the shaft element so as to produce sensation in a user utilizing the shaft element against genitals or inside a human orifice, (c) a flexible cord coupled to a distal end of the shaft element, the cord configured for having a tensile strength of at least 20 pounds per square inch, (d) one or more spherical elements coupled to the cord and located between ends of the cord, the spherical elements configured for insertion into a human orifice and for producing sensation in the user; and (e) one or more crystal elements coupled to the cord and located between the ends of the cord, the crystal elements configured for insertion into a human orifice and for producing sensation in the user.

19 Claims, 4 Drawing Sheets

SEXUAL AID APPARATUS WITH SAFETY DEVICE

CROSS-REFERENCE TO RELATED APPLICATIONS

Not Applicable

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to human safety and, more specifically, to safety devices used with sexual aid apparatuses.

BACKGROUND

Sexual aid devices, otherwise known as sex toys, have enjoyed increasing sales in recent years. What was considered a nascent industry only a few years ago, has now grown into a 15 billion worldwide industry, with projections of a 30 billion worldwide industry by 2020. The increase in the rate of growth of the sex toy industry has been attributed to a variety of factors, including more relaxed views on sex, the growing popularity of vibrators for therapeutic purposes, the rapid growth of e-commerce, an increase in the lesbian population, as well as other societal factors. Regardless of the causal factors, there is an increase in the availability of sex toys among the population, and a corresponding increase in the use of sex toys by men and woman alike.

The use of sex toys, however, comes with certain risks. A common risk associated with the use of prosthetic penises, or dildos, for example, is the inadvertent impaction of the toy within a human orifice, such as the anus. Rectal foreign bodies, as they are called, are well known in the medical literature and are a common affliction treated in emergency rooms worldwide. It is known that most patients presenting with a rectal foreign body can be treated in the emergency room. That is, the rectal foreign body can be removed transanally in the emergency room. If the patient does not cooperate due to discomfort or pain during the procedure, however, repetitive attempts to removing the rectal foreign body may be necessary. This might result in the rectal foreign body being shifted deeper into the anal canal or in anal sphincter damage. In such cases, anesthesia may be applied to the patient before continuing attempts. In cases where the rectal foreign body is very large or complications (such as rectal perforation or peritonitis) are found, a proctocolectomy or an enterostomy through a laparotomy might be necessary. In more complicated cases, spinal or pudendum anesthesia may be required. After removal of the rectal foreign body, the patient is often observed for a period of time in case of complications such as delayed damage caused by the rectal foreign body.

Needless to say, the impaction of a sexual aid device within a human orifice, such as the anus, can be painful, dangerous and harmful to human health. Unfortunately, there are few, if any, safety devices currently available that prevent impaction of a sexual aid device or aid in its removal in the event of an impaction.

Therefore, a need exists for improvements over the prior art, and more particularly for devices and processes for improving the safety of sex toys.

SUMMARY

A sexual aid apparatus for reducing or eliminating inadvertent impaction of the apparatus within a human orifice is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, the apparatus includes (a) a shaft element configured to emulate a human penis and to be placed against genitals or inside a human orifice, (b) an electric vibrating motor located within the shaft element, the electric vibrating motor configured for vibrating the shaft element so as to produce sensation in a user utilizing the shaft element against genitals or inside a human orifice, (c) a flexible cord coupled to a distal end of the shaft element, the cord configured for having a tensile strength of at least 20 pounds per square inch, (d) one or more spherical elements coupled to the cord and located between ends of the cord, the spherical elements configured for insertion into a human orifice and for producing sensation in the user; and (e) one or more crystal elements coupled to the cord and located between the ends of the cord, the crystal elements configured for insertion into a human orifice and for producing sensation in the user.

BRIEF DESCRIPTION OF THE DRAWINGS

The claimed subject matter is particularly pointed out and distinctly claimed in the claims at the conclusion of the specification. The foregoing and other features and also the advantages of the claimed subject matter will be apparent from the following detailed description taken in conjunction with the accompanying drawings. Additionally, the left most digit of a reference number may identify the drawing in which the reference number first appears. The accompanying drawings, which are incorporated in and constitute a part of this disclosure, illustrate various example embodiments. In the drawings:

DETAILED DESCRIPTION

Figure 1:
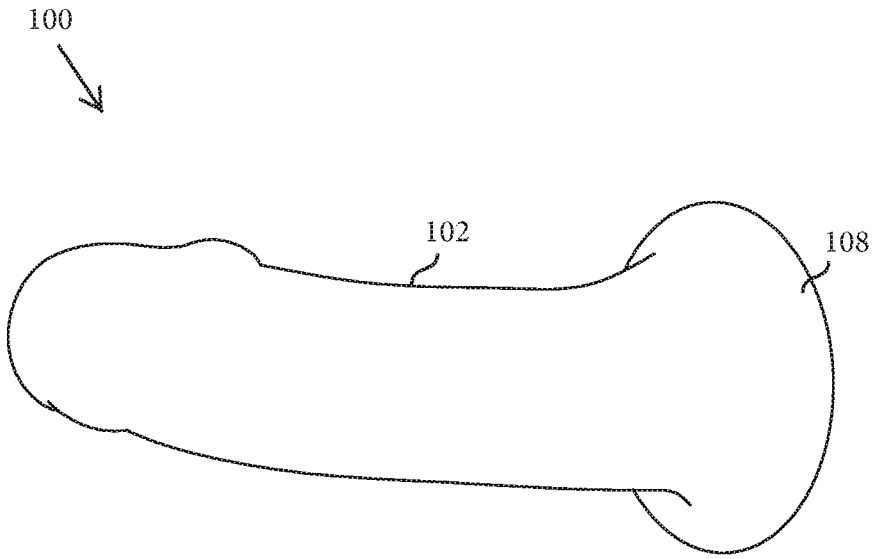
FIG. 1 is an illustration of a prosthetic penis sexual aid apparatus.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The disclosed embodiments improve over the prior art by providing a simple and easy-to-use safety device for use with a sexual aid apparatus, such that impaction of the apparatus within a human orifice may be prevented or undone. The disclosed safety device reduces or eliminates the possibility that the sexual aid apparatus becomes impacted during use and further, if impaction does occur, the impaction can be removed using the safety device. The features of the disclosed embodiments further decrease the possibility of bodily harm occurring in a user that experiences impaction. The disclosed embodiments also reduce or eliminate that more complicated procedures are necessary when removing an impaction. The disclosed embodiments also improve over the prior art by providing a simplified mechanism for removing an impacted sexual aid apparatus if impaction occurs. This feature increases the chances that the use can remove an impaction himself, if impaction does occur, without requiring medical assistance.

FIG. 1 is an illustration of a prosthetic penis sexual aid apparatus 100. The apparatus 100 is an apparatus that is well known in the art and can be referred to as a dildo. A dildo is an apparatus usually designed for penetration of the vagina, mouth, or anus, and is usually solid and phallic in shape. Such apparatuses can be used by people of all genders and sexual orientations, for masturbation or for other sexual activity. Dildos can be manufactured from a variety of different materials, including rubber, silicone, PVC, jelly rubber, plastic, steel, metal, glass, borosilicate glass, and cyberskin (a type of thermoplastic sex toy material that is composed of a variety of elements and feels like human skin). The apparatus 100 may also include an anti-bacterial layer or covering that features anti-bacterial qualities.

The prosthetic penis sexual aid apparatus 100 may include an electric vibrating motor located within the shaft element, the electric vibrating motor configured for vibrating the shaft element so as to produce sensation in a user when used against male or female genitals or inside a human orifice, such as a vagina, mouth or anus.

The prosthetic penis sexual aid apparatus 100 may include a shaft element 102, which may emulate a human penis and is configured (in size, shape, composition, width, length, elasticity, texture and color) to be placed against male or female genitals or inside a human orifice, such as a vagina, mouth or anus. The prosthetic penis sexual aid apparatus 100 may also include a base 108, which may have an outer diameter that is larger than the outer diameter of the shaft 102.

Figure 2:
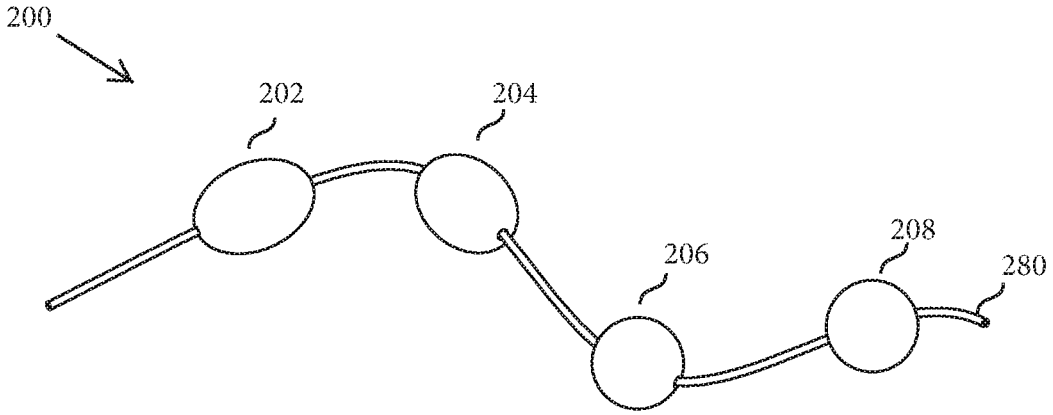
FIG. 2 is an illustration of a safety device used with the prosthetic penis sexual aid apparatus, according to a first example embodiment.

FIG. 2 is an illustration of a safety device 200 used with the prosthetic penis sexual aid apparatus 100, according to a first example embodiment. The safety device 200 includes a flexible cord 280 configured to be coupled to a distal end of the prosthetic penis sexual aid apparatus 100 or the shaft element 102. The cord 280 is configured for having a tensile strength of at least 20 pounds per square inch or psi. 1 psi is approximately equal to 6895 $N/m^2$. Alternatively, the cord 280 is configured for having a tensile strength of at least 10 psi, 30 psi, 40 psi and 50 psi.

The safety device 200 includes one or more spherical elements 206, 208 coupled to the cord 280 and located between ends of the cord, the spherical elements configured for insertion into a human orifice and for producing sensation in the user. The one or more spherical elements 206, 208 may include an electric vibrating motor located within the elements, the electric vibrating motor configured for vibrating the spherical elements so as to produce sensation in a user when used against male or female genitals or inside a human orifice, such as a vagina, mouth or anus. The one or more spherical elements 206, 208 may be coupled to the cord via a bore in each spherical element, through which the cord extends.

The safety device 200 includes one or more crystal elements 202, 204 coupled to the cord 280 and located between the ends of the cord, the crystal elements configured for insertion into a human orifice and for producing sensation in the user. The crystal elements 202, 204 may be ellipsoid shaped or spherical shaped and may be composed of a crystal comprising solid material whose constituents are arranged in a highly ordered microscopic structure, forming a crystal lattice that extends in all directions. Crystals are often used in pseudoscientific practices such as crystal therapy, and, along with gemstones, are sometimes associated with religious movements. The crystal elements 202, 204 may also be composed of gemstones, which are pieces of mineral crystal that are polished. Examples of gemstones are: turquoise, hematite, quartz, jasper, malachite, ruby, pyrite, etc. Certain rocks (such as lapis lazuli, opal, and jade) or organic materials that are not minerals (such as amber, jet, and pearl) are also often considered to be gemstones as well. The one or more crystal elements 202, 204 may be coupled to the cord via a bore in each spherical element, through which the cord extends.

Figure 3:
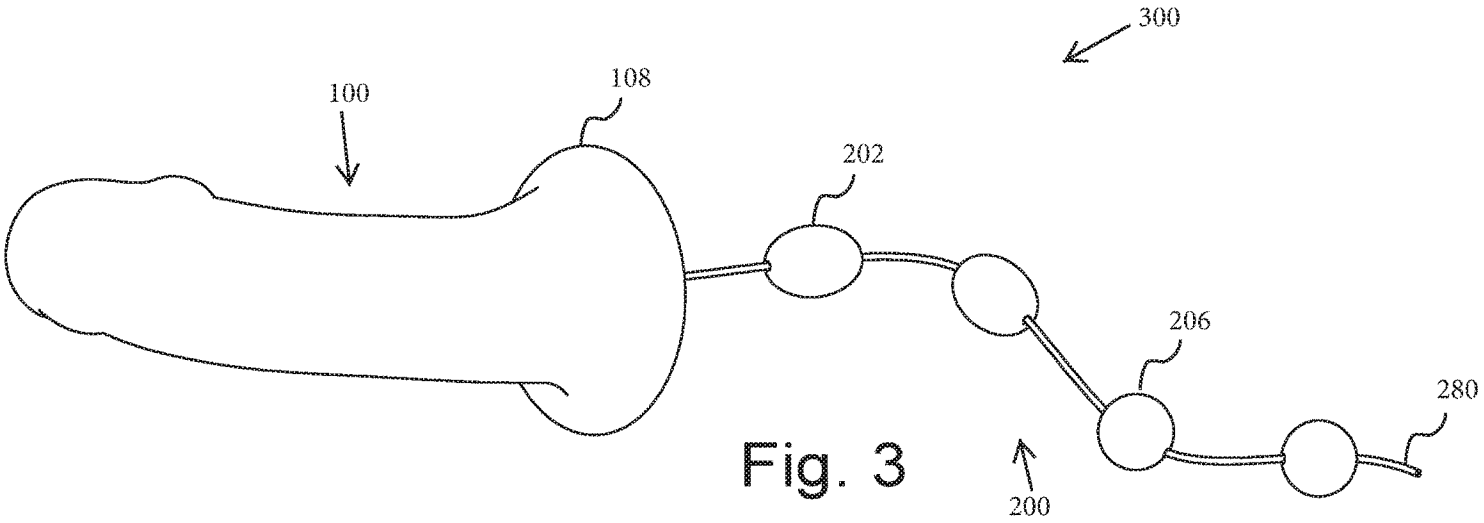
FIG. 3 is an illustration of a safety device combined with the prosthetic penis sexual aid apparatus, according to the first example embodiment.

FIG. 3 is an illustration of the safety device 200 combined with the prosthetic penis sexual aid apparatus 100, according to the first example embodiment 300. FIG. 3 shows that a proximal end of the cord 280 of the safety device 200 is coupled to a distal end (specifically, the base 108) of the prosthetic penis sexual aid apparatus 100. This arrangement allows the user to pull on the cord 280 in a distal direction, either to remove the prosthetic penis sexual aid apparatus 100 if it has become impacted, or to prevent the prosthetic penis sexual aid apparatus 100 from being impacted in a human orifice.

Figure 4:
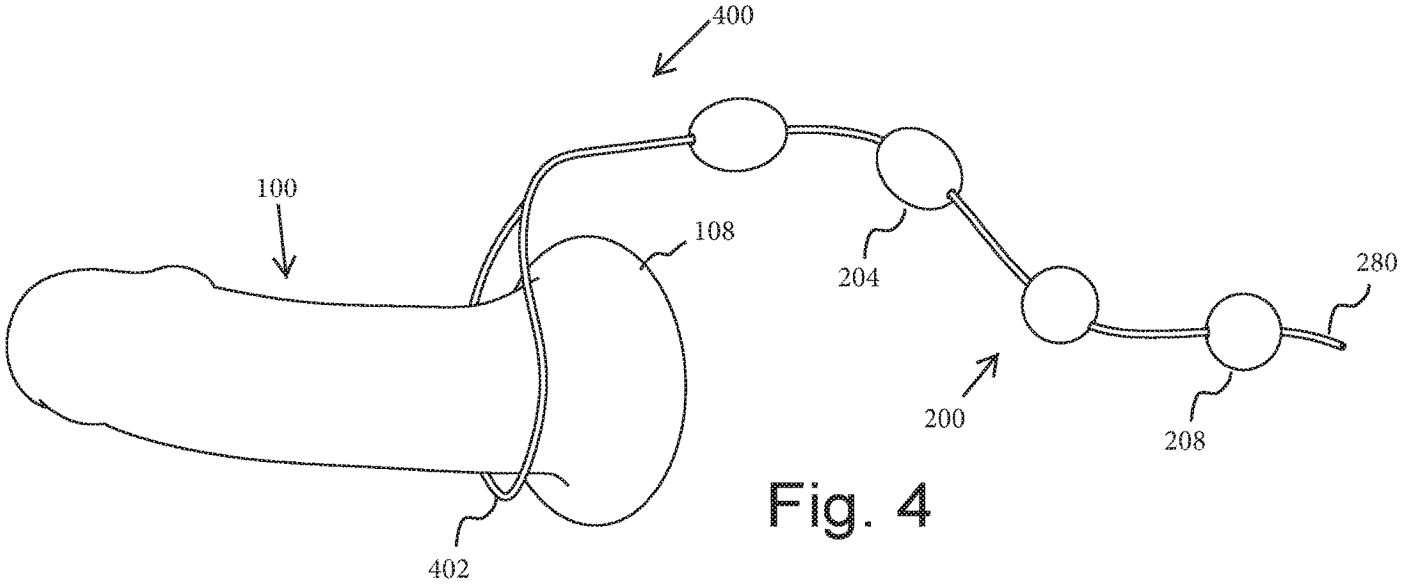
FIG. 4 is an illustration of the safety device combined with the prosthetic penis sexual aid apparatus, according to a second example embodiment.

FIG. 4 is an illustration of the safety device 200 combined with the prosthetic penis sexual aid apparatus 100, according to a second example embodiment 400. FIG. 3 shows that a proximal end of the cord 280 of the safety device 200 comprises a loop or knot 402 that surrounds the distal end (specifically, the base 108) of the prosthetic penis sexual aid apparatus 100. The loop or knot 402 may be configured to tighten when the cord 280 is pulled in the distal direction, such as a slipknot. Recall the prosthetic penis sexual aid apparatus 100 may include a base 108, which may have an outer diameter that is larger than the outer diameter of the shaft 102. This prevents the loop or knot 402 of the cord 280 from slipping off the sexual aid apparatus 100 if the cord is pulled distally. Again, this arrangement allows the user to pull on the cord 280 in a distal direction, either to remove the prosthetic penis sexual aid apparatus 100 if it has become impacted, or to prevent the prosthetic penis sexual aid apparatus 100 from being impacted in a human orifice.

Figure 5:
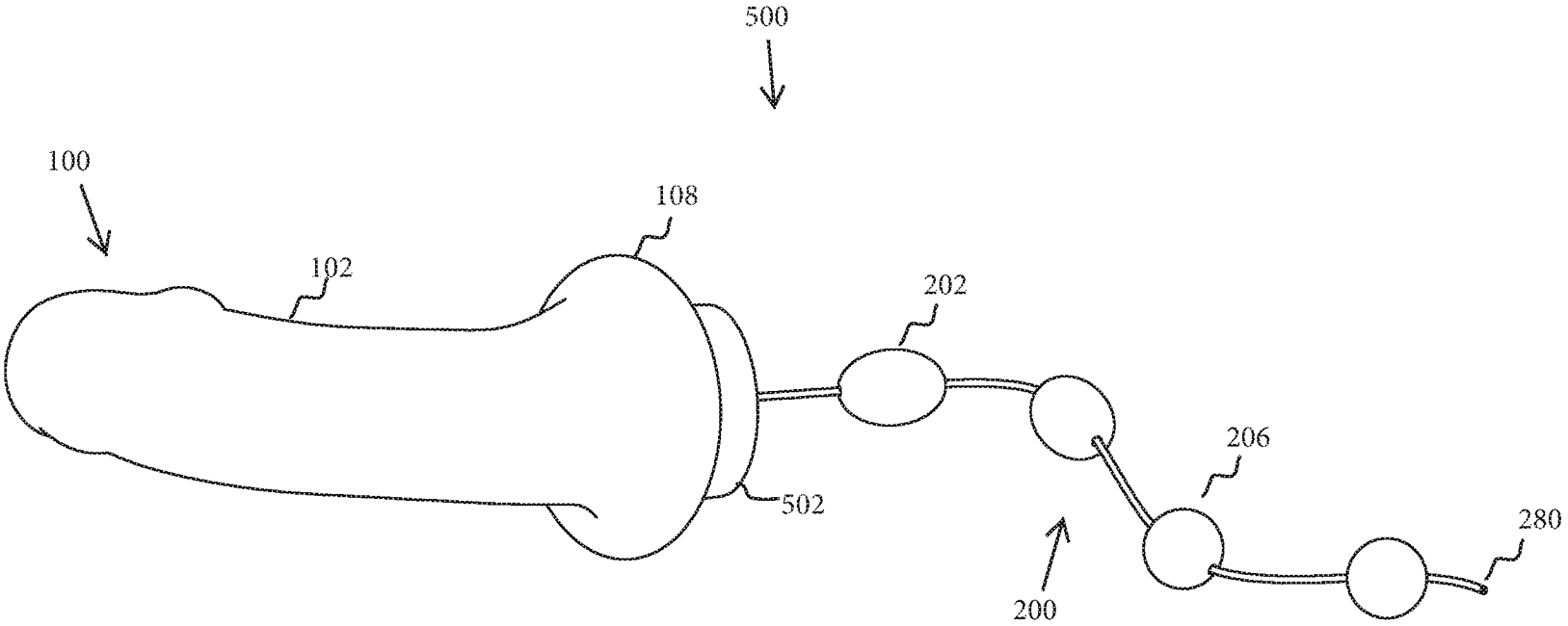
FIG. 5 is an illustration of the safety device combined with the prosthetic penis sexual aid apparatus, according to a third example embodiment.

FIG. 5 is an illustration of the safety device 200 combined with the prosthetic penis sexual aid apparatus 100, according to a third example embodiment 500. FIG. 5 shows that a proximal end of the cord 280 of the safety device 200 is coupled to a distal end (specifically, a cap 502) of the prosthetic penis sexual aid apparatus 100. The cap 502 may be a removable cover that provides access to an inner volume within the sexual aid apparatus 100, wherein said inner volume may be a battery compartment, a compartment to access a vibrating motor or other compartment within the sexual aid apparatus 100. Again, this arrangement allows the user to pull on the cord 280 in a distal direction, either to remove the prosthetic penis sexual aid apparatus 100 if it has become impacted, or to prevent the prosthetic penis sexual aid apparatus 100 from being impacted in a human orifice.

Figure 6:
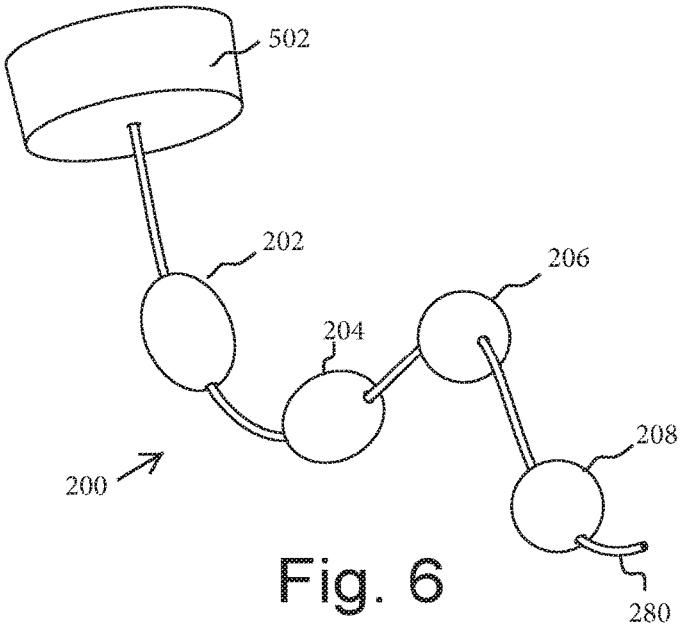
FIG. 6 is an illustration of the safety device for use with the prosthetic penis sexual aid apparatus, according to the third example embodiment.

FIG. 6 is an illustration of the safety device 200 for use with the prosthetic penis sexual aid apparatus 100, according to the third example embodiment. FIG. 6 shows that the distal end of the cord 280 has been attached to the cap 502, which is, in turn, is coupled to the distal end of the sexual aid apparatus 100, such as the base 108.

Figure 7:
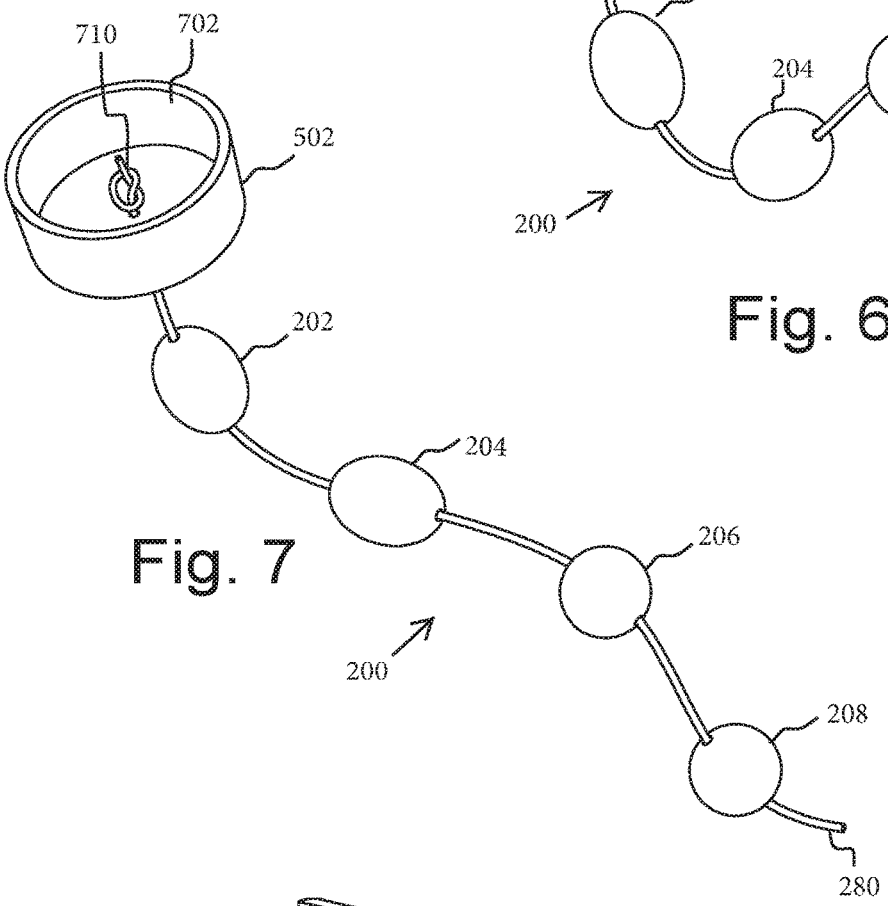
FIG. 7 is another illustration of the safety device for use with the prosthetic penis sexual aid apparatus, according to the third example embodiment.

FIG. 7 is another illustration of the safety device 200 for use with the prosthetic penis sexual aid apparatus 100, according to the third example embodiment. FIG. 7 shows that the distal end of the cord 280 has been attached to the cap 502, which is, in turn, is coupled to the distal end of the sexual aid apparatus 100, such as the base 108. The cap 502 may be a cylindrical shaped object that has an inner surface 702 that is threaded such that the cap may be threaded or screwed onto an outer surface of the distal end of the sexual aid apparatus 100, such as the base 108. In one embodiment, there is an orifice in the flat round surface of the cap 502, though which the cord 280 extends. Thereby, a knot 710 is tied in the end of the cord 280, so as to prevent the cord 280 from being removed from the cap 502 when the cord is pulled in the distal direction.

Figure 8:
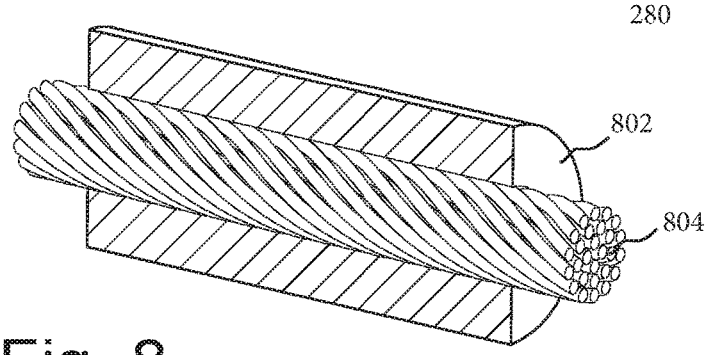
FIG. 8 is an illustration of the interior components of the safety device for use with the prosthetic penis sexual aid apparatus, according to the first, second and third example embodiments.

FIG. 8 is an illustration of the interior components of the safety device 200 for use with the prosthetic penis sexual aid apparatus 100, according to the first, second and third example embodiments. The cord 280 may comprise a rope constructed with its interior core 804 protected by a rubber or plastic sheath 802 designed to optimize strength, durability, cleanliness, elasticity, softness and flexibility. The core fibers 804 provide the tensile strength of the cord 280, while the sheath 802 protects the core from debris, unclean material, and abrasion during use. The sheath also protects the user from being scratched or otherwise marred by the core fibers 804. The cord 280 may be dynamic for greater elasticity or static.

In one embodiment, the safety device 200 and sexual aid apparatus 100 may be utilized with a disposable vacuum seal plastic pouch configured for surrounding and sealing at least the shaft element 102 of the sexual aid apparatus 100, the pouch configured for form-fitting at least the shaft element and for removal from said shaft element after use. This arrangement amounts to the sexual aid apparatus 100 being vacuum packed. Vacuum packing is a method of packaging that removes air from the package prior to sealing. This method involves placing the sexual aid apparatus 100 in the disposable vacuum seal plastic pouch, removing air from inside, and sealing the pouch. Shrink film may be used to form fit to the sexual aid apparatus 100.

Vacuum packing reduces or eliminates the possibility of bacteria, unclean material or debris coming into contact with the sexual aid apparatus 100 during use. After use, the pouch may be disposed of, and a new pouch used for a new session of use. Vacuum packing can also be used to store the sexual aid apparatus 100, so as to protect the apparatus from bacterial growth, debris or other unclean material.

Devices 100 and 200 and their components may be manufactured from a variety of materials including rubber, plastic, metal, such as stainless steel, titanium, aluminum or any metal alloy, rigid fabric, carbon fiber, epoxy resin, graphite, or any combination of the above. Devices 100 and 200 and their components may also be manufactured from a synthetic man-made material.

Plastic covers a range of synthetic or semi-synthetic polymerization products. Plastics are composed of organic condensation or addition polymers and may contain other substances to improve performance or economics. Plastic may comprise any one of the following forms of plastic: polyethylene, polystyrene, high impact polystyrene, polyethylene terephthalate, nylon, polypropylene, acrylonitrile butadiene styrene (ABS), bayblend and polyvinylidene chloride (PVC).

Devices 100, 200 and their components may be manufactured from a plastic compound using any variety of processes, such as injection molding, fusible core injection molding and thermoforming.

While certain embodiments have been described, other embodiments may exist. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A sexual aid apparatus with a safety feature, the apparatus comprising:

(a) a shaft element configured to emulate a human penis and to be placed against genitals or inside a human orifice;

(b) an electric vibrating motor located within the shaft element, the electric vibrating motor configured for vibrating the shaft element so as to produce sensation in a user when used against genitals or inside a human orifice;

(c) a flexible cord coupled to a distal end of the shaft element, the cord configured for having a tensile strength of at least 20 pounds per square inch;

(d) one or more spherical elements coupled to the cord and located between ends of the cord, the one or more spherical elements configured for insertion into a human orifice and for producing sensation in the user; and (e) one or more crystal elements coupled to the cord and located between the ends of the cord, the one or more crystal elements configured for insertion into a human orifice and for producing sensation in the user.

2. The sexual aid apparatus of claim 1, further comprising:

(f) a disposable vacuum seal plastic pouch configured for surrounding and sealing at least the shaft element of the sexual aid apparatus, the pouch configured for form-fitting at least the shaft element and for removal from said shaft element after use.

3. The sexual aid apparatus of claim 1, wherein the flexible cord is coupled to the distal end of the shaft element via a loop that surrounds the shaft element.

4. The sexual aid apparatus of claim 1, further comprising a cap that is coupled to a distal end of the shaft element, wherein the flexible cord is coupled to the cap.

5. The sexual aid apparatus of claim 2, wherein the flexible cord comprises a core fiber surrounded by a rubber sheath.

6. The sexual aid apparatus of claim 5, wherein the one or more spherical elements are coupled to the cord via a bore in each spherical element, through which the cord extends.

7. The sexual aid apparatus of claim 6, wherein the one or more crystal elements are coupled to the cord such that the cord extends through a bore in each of the one or more crystal elements.

8. A sexual aid apparatus with a safety feature, the apparatus comprising:

(a) a shaft element configured to emulate a human penis and to be placed against genitals or inside a human orifice;

(b) an electric vibrating motor located within the shaft element, the electric vibrating motor configured for vibrating the shaft element so as to produce sensation in a user when used against genitals or inside a human orifice;

(c) a flexible cord coupled to a distal end of the shaft element, the cord configured for having a tensile strength of at least 20 pounds per square inch;

(d) one or more spherical elements coupled to the cord and located between ends of the cord, the one or more spherical elements configured for insertion into a human orifice and for producing sensation in the user;

(e) one or more crystal elements coupled to the cord and located between the ends of the cord, the one or more crystal elements configured for insertion into a human orifice and for producing sensation in the user; and (f) a disposable vacuum seal plastic pouch configured for surrounding and sealing at least the shaft element of the sexual aid apparatus, the pouch configured for form-fitting at least the shaft element and for removal from said shaft element after use.

9. The sexual aid apparatus of claim 8, wherein the flexible cord is coupled to the distal end of the shaft element via a loop that surrounds the shaft element.

10. The sexual aid apparatus of claim 8, further comprising a cap that is coupled to a distal end of the shaft element, wherein the flexible cord is coupled to the cap.

11. The sexual aid apparatus of claim 8, wherein the flexible cord comprises a core fiber surrounded by a rubber sheath.

12. The sexual aid apparatus of claim 11, wherein the one or more spherical elements are coupled to the cord via a bore in each spherical element, through which the cord extends.

13. The sexual aid apparatus of claim 12, wherein the one or more crystal elements are coupled to the cord via a bore in each of the one or more crystal elements, through which the cord extends.

14. A safety device for use with a sexual aid apparatus, the safety device comprising:

(a) a cap located at a distal end of the sexual aid apparatus;

(b) a flexible cord configured for coupling to the cap of the sexual aid apparatus, the cord configured for having a tensile strength of at least 20 pounds per square inch;

(c) one or more spherical elements coupled to the cord and located between ends of the cord, the one or more spherical elements configured for insertion into a human orifice and for producing sensation in a user; and (d) one or more crystal elements coupled to the cord and located between the ends of the cord, the one or more crystal elements configured for insertion into a human orifice and for producing sensation in the user.

15. The safety device of claim 14, wherein the flexible cord is configured for coupling to the cap of the sexual aid apparatus via an orifice in the cap, through which the cord extends.

16. The safety device of claim 14, wherein the flexible cord comprises a core fiber surrounded by a rubber sheath.

17. The safety device of claim 16, wherein the one or more spherical elements are coupled to the cord via a bore in each spherical element, through which the cord extends.

18. The safety device of claim 17, wherein the one or more crystal elements are coupled to the cord via a bore in each of the one or more crystal elements, through which the cord extends.

19. The safety device of claim 18, wherein the flexible cord comprises an anti-bacterial composition.

* * * * *